US009496668B1

(12) United States Patent
Baker et al.

(10) Patent No.: US 9,496,668 B1
(45) Date of Patent: Nov. 15, 2016

(54) CONNECTION STRUCTURES FOR ELECTRICAL COMPONENTS IN AN ELECTRONIC DEVICE

(71) Applicant: Apple Inc., Cupertino, CA (US)

(72) Inventors: John J. Baker, Cupertino, CA (US); Brad G. Boozer, Saratoga, CA (US); Craig M. Stanley, Campbell, CA (US); Erik L. Wang, Redwood City, CA (US); Nathan P. Bosscher, Campbell, CA (US); Phillip Michael Hobson, Menlo Park, CA (US); Stephen P. Zadesky, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/720,059

(22) Filed: May 22, 2015

Related U.S. Application Data

(60) Provisional application No. 62/057,609, filed on Sep. 30, 2014.

(51) Int. Cl.

| | |
|---|---|
| ***H01R 13/74*** | (2006.01) |
| ***H01R 13/73*** | (2006.01) |
| ***H01R 35/02*** | (2006.01) |
| ***H01R 13/50*** | (2006.01) |
| ***H01R 25/00*** | (2006.01) |
| ***H01R 27/02*** | (2006.01) |
| ***H01R 13/717*** | (2006.01) |
| ***H01R 13/66*** | (2006.01) |

(52) U.S. Cl.
CPC ..... *H01R 35/02* (2013.01); *H01R 13/50* (2013.01); *H01R 13/665* (2013.01); *H01R 13/6683* (2013.01); *H01R 13/717* (2013.01); *H01R 25/006* (2013.01); *H01R 27/02* (2013.01)

(58) Field of Classification Search
CPC ..... H01R 13/72; H01R 13/73; H01R 13/74; H01R 13/665; H01R 13/6683; H01R 27/02; H01R 13/717; H01R 13/46
USPC ..... 439/544, 540.1, 557, 560, 567, 76.1, 78
See application file for complete search history.

(56) References Cited

U.S. PATENT DOCUMENTS

| | | | | |
|---|---|---|---|---|
| 6,113,424 | A * | 9/2000 | Shinozaki | H01R 13/5202 439/556 |
| 6,426,882 | B1 * | 7/2002 | Sample | G06F 1/181 220/4.02 |
| 6,619,858 | B1 | 9/2003 | Lytel et al. | |
| 7,192,305 | B2 * | 3/2007 | Kato | H01R 13/74 439/544 |
| 8,282,290 | B2 | 10/2012 | Mulfinger et al. | |
| 2006/0094293 | A1 * | 5/2006 | Daggett | H01R 13/6273 439/544 |
| 2008/0164055 | A1 * | 7/2008 | Wang | G06F 1/189 174/260 |
| 2013/0313097 | A1 * | 11/2013 | Yabe | H01H 13/705 200/520 |
| 2015/0016783 | A1 | 1/2015 | Leigh et al. | |
| 2015/0092382 | A1 | 4/2015 | Chang | |

* cited by examiner

*Primary Examiner* — Abdullah Riyami
*Assistant Examiner* — Harshad Patel
(74) *Attorney, Agent, or Firm* — Kilpatrick Townsend & Stockton LLP

(57) ABSTRACT

An electronic device may have a rigid support structure to which electrical components are mounted. The rigid support structure may be an electronic device housing structure such as a housing wall having openings that receive the electrical components. The electrical components may have electrical component connectors. A printed circuit board may be used to convey signals for the electrical components. Connectors may be mounted to the printed circuit board. Lateral shift accommodation structures may be formed between the electrical component connectors and the electrical components or in the vicinity of the connectors on the printed circuit to allow the connectors on the printed circuit to mate with the electrical component connectors of the rigidly mounted electrical components.

22 Claims, 19 Drawing Sheets

CONNECTION STRUCTURES FOR ELECTRICAL COMPONENTS IN AN ELECTRONIC DEVICE

This application claims the benefit of provisional patent application No. 62/057,609, filed Sep. 30, 2014, which is hereby incorporated by reference herein in its entirety.

BACKGROUND

This relates generally to electronic devices, and more particularly, to electronic devices with electronic components that are interconnected using printed circuits.

Electronic devices include electronic components. Components are sometimes mounted in fixed positions relative to each other. For example, an array of electrical components may be mounted to a rigid support structure so that there is no significant movement between the components.

Electrical components are typically interconnected with signal paths. For example, a printed circuit may be coupled to each of the electrical components in an array so that signal paths on the printed circuit can be used to convey signals for the electrical components. Challenges may arise when attempting to couple signal paths in a printed circuit to an array of electrical components mounted to a rigid support structure. Because the electrical components on a rigid support structure are in fixed positions, the electrical components cannot shift positions with respect to each other to accommodate manufacturing variations in the positions of the signal path structures on the printed circuit or manufacturing variations in the electrical components and rigid support structure. As a result, it may be difficult or impossible to mate the signal paths in the printed circuit to the electrical components without damage.

It would therefore be desirable to be able to provide improved arrangements for coupling printed circuits to electrical components in an electronic device.

SUMMARY

An electronic device may have a rigid support structure to which electrical components are mounted. The rigid support structure may be an electronic device housing structure such as a housing wall having openings that receive the electrical components. The electronic device housing wall may have a cylindrical shape. The openings may be circular openings that receive circular electrical components or may have other shapes.

The electrical components may have electrical component connectors. A printed circuit board may be used to handle signals for the electrical components. Connectors may be mounted to the printed circuit board. Lateral shift accommodation structures may allow the connectors on the printed circuit to mate with the electrical component connectors associated with the rigidly mounted electrical components.

The lateral shift accommodation structures may be formed from flexible structures having flexible support arms or other members that are interposed between the electrical components and the electrical component connectors. The flexible structures may be attached to the electrical components using screws or other attachment mechanisms. The electrical component connectors may be supported on the flexible structures.

Lateral shift accommodation structures may also be formed from openings in the printed circuit. The openings may be elongated slot-shaped openings that curve around each connector on the printed circuit. The openings allow the printed circuit to flex laterally so that the connectors on the printed circuit mate with the electrical component connectors on the rigid support structure.

DETAILED DESCRIPTION

Electronic devices may include components. The components may be light-based components, audio components, sensors, or other electrical components. The components may be mounted to a rigid support structure and may be interconnected using signal paths in substrates such as printed circuits. The support structure to which the electrical components are mounted may be part of an electronic device. For example, the components may be mounted to a support structure within the interior of an electronic device and/or may be mounted to a housing wall or other support structure on the exterior of an electronic device. Configurations in which electrical components are mounted to a rigid support structure such as an electronic device housing wall and in which the electrical components are exposed on the exterior of the housing may facilitate signal input and output operations using the components (e.g., input and output operations involving light signals, acoustic signals, temperature information, etc.). Accordingly, configurations in which components are mounted within openings in housing surfaces are sometimes described herein as an example.

In some devices, it may be desirable to mount multiple components in proximity to each other. For example, optical components may be mounted in proximity to each other to form a display with an array of pixels or to form other types of light output devices (e.g., a light-based status indicator), speakers may be mounted in an array to form a phased speaker array or to provide enhanced output levels, microphones may be mounted in an array to gather audio information from multiple directions, proximity sensors may be mounted in an array to create a touch or motion input device that can capture input from a user's hand or other external object, and other sensors and input-output components may be mounted in arrays to enhance the ability of an electronic device to gather input and provide output.

Multiple components may be mounted adjacent to one another in a regular array having one or more rows and one or more columns of electrical components. Components may also be organized in a less regular fashion such as a pseudorandom pattern on the surface of a device housing.

Illustrative electronic devices that may be provided with components are shown in FIGS. 1, 2, 3, 4, and 5.

Figure 1:
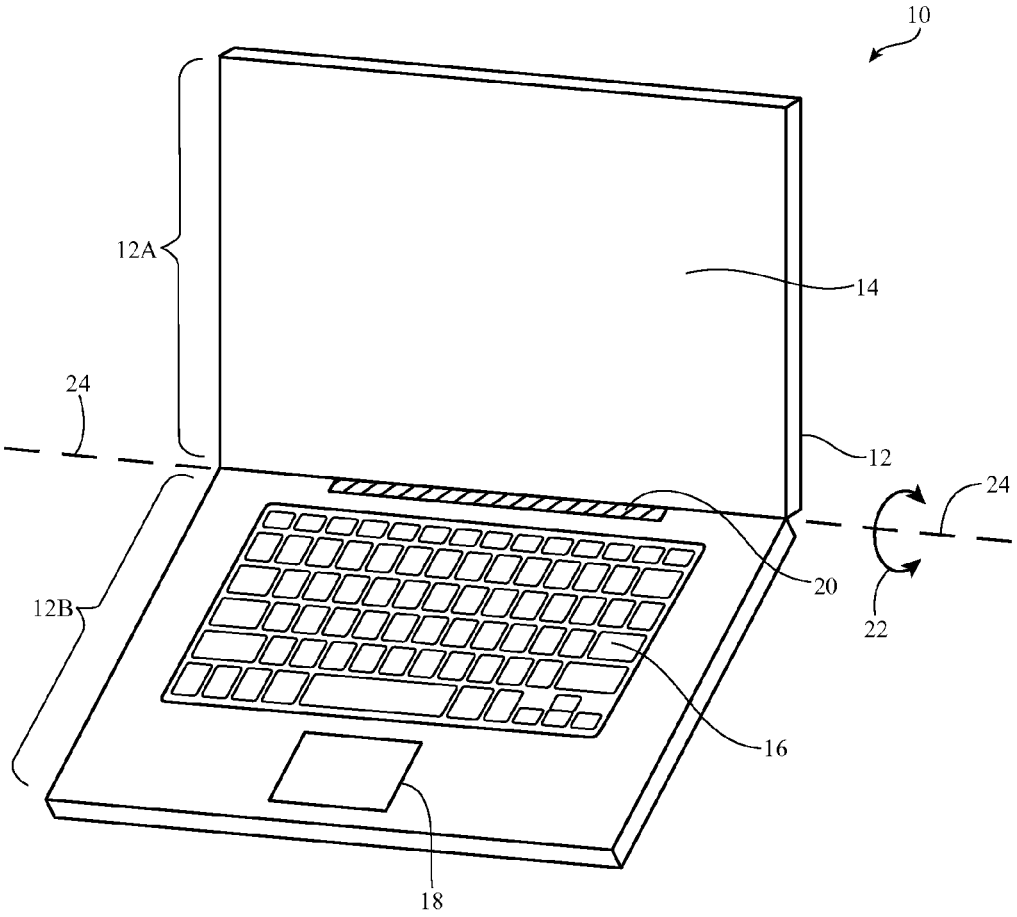
FIG. 1 is a perspective view of an illustrative electronic device such as a laptop computer in accordance with an embodiment.

Illustrative electronic device 10 of FIG. 1 has the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes be referred to as a display housing or lid, may be placed in a closed position by rotating upper housing 12A towards lower housing 12B about rotational axis 24.

Figure 2:
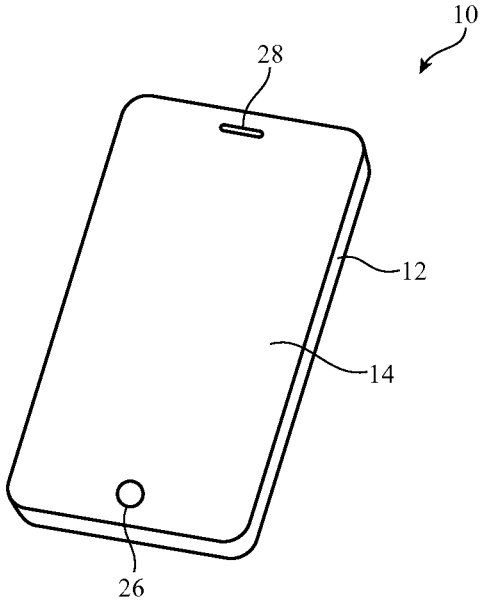
FIG. 2 is a perspective view of an illustrative electronic device such as a handheld electronic device in accordance with an embodiment.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2).

Figure 3:
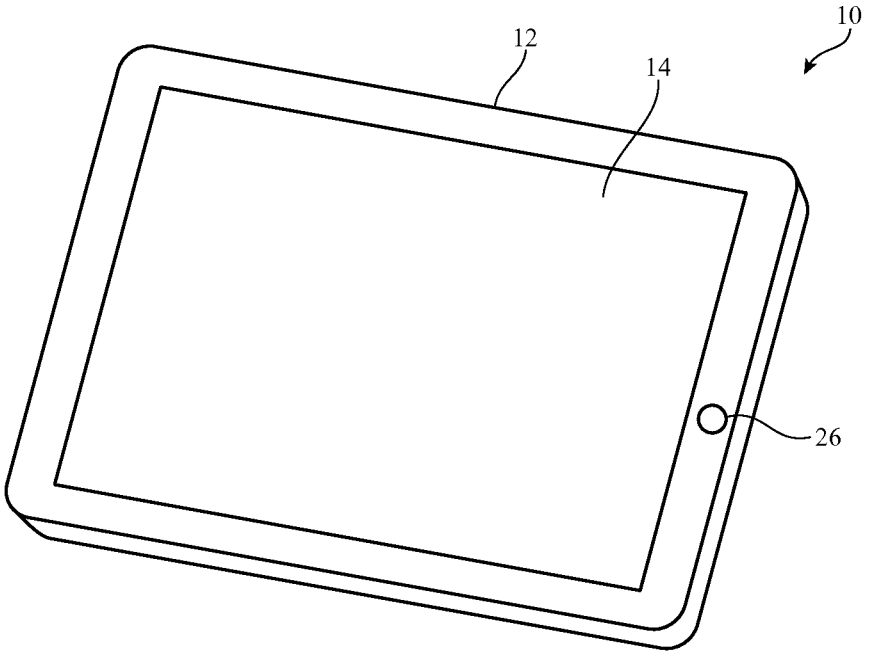
FIG. 3 is a perspective view of an illustrative electronic device such as a tablet computer in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
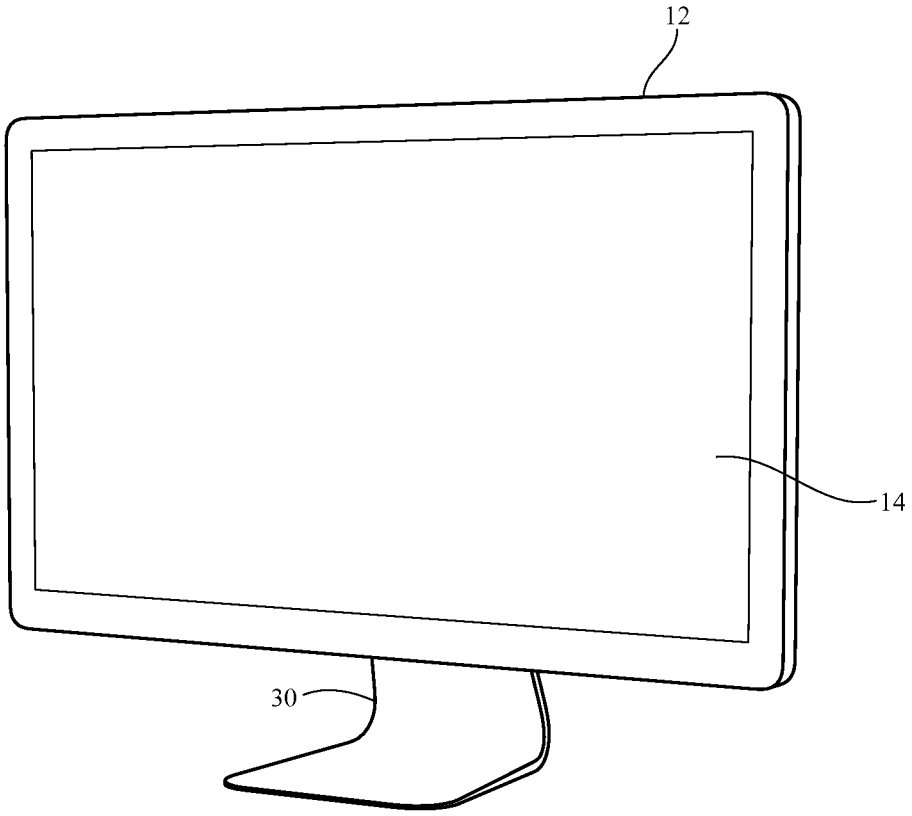
FIG. 4 is a perspective view of an illustrative electronic device such as a computer display in accordance with an embodiment.

FIG. 4 shows how electronic device 10 may be a computer display, a computer that has been integrated into a computer display, or a display for other electronic equipment. With this type of arrangement, housing 12 for device 10 may be mounted on a support structure such as stand 30 or stand 30 may be omitted (e.g., stand 30 can be omitted when mounting device 10 on a wall). Display 14 may be mounted on a front face of housing 12.

Figure 5:
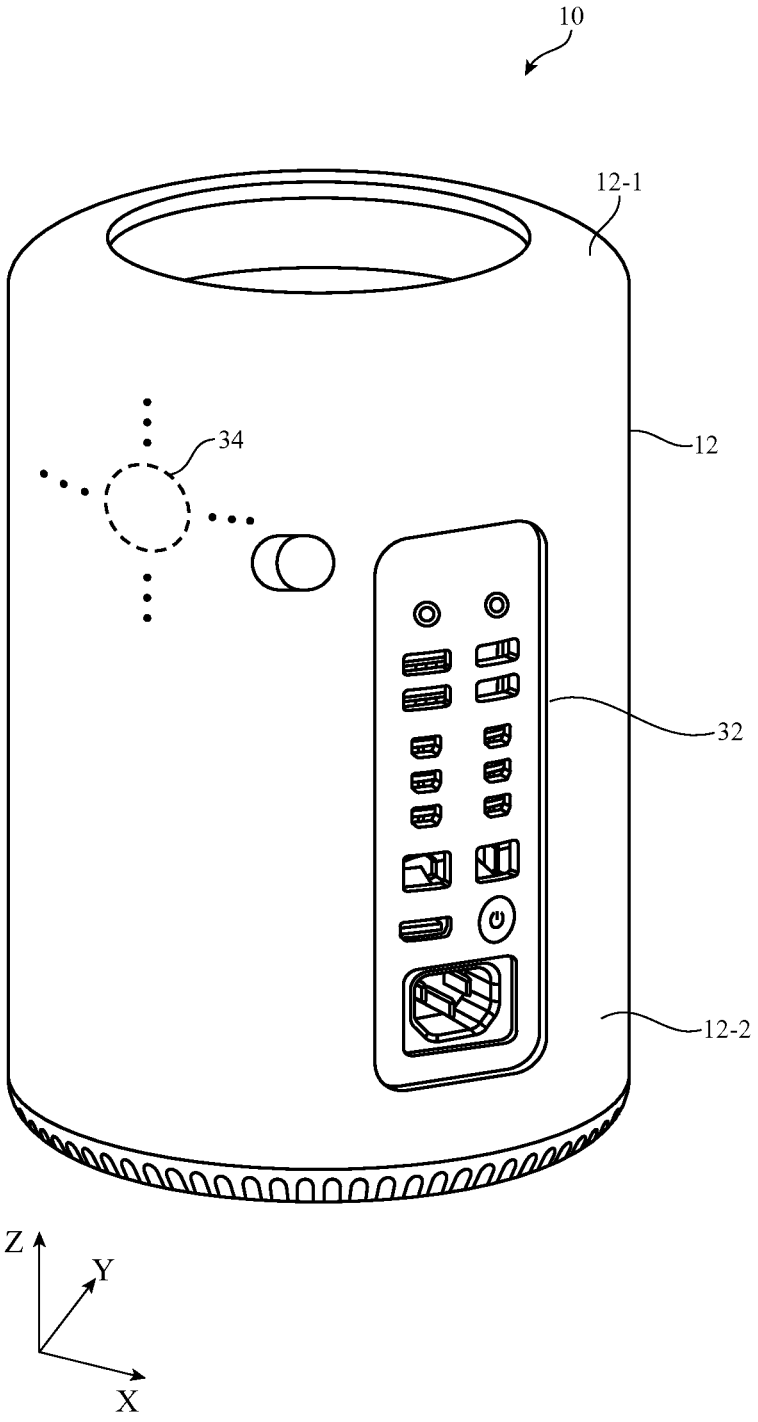
FIG. 5 is perspective of an illustrative electronic device such as a computing device or other device with a cylindrical housing that surrounds an interior region and that is surrounded by an exterior region in accordance with an embodiment.

FIG. 5 shows how electronic device 10 may have a cylindrical housing. Device 10 may be, for example, a desktop computer such as the Mac Pro computer available from Apple Inc. of Cupertino, Calif. Housing 12 may have an input-output connector region such as region 32 that contains input-output connectors (e.g., Universal Serial Bus connectors and other digital signal connectors, power connectors, audio connectors, memory card slots, and other input-output connectors). Upper surface 12-1 of housing 12 may be planar or may have curved surfaces (as shown in FIG. 5). Sidewall 12-2 of housing 12 may have a curved surface so that housing 12 has a cylindrical shape (as an example). Housing 12 may also have other shapes (e.g., conical shapes, pyramidal shapes with curved and/or planar sidewall surfaces, spherical housing shapes, other shapes, and combinations of these shapes).

Housing 12 may have a vertical dimension (height in dimension Z) that is larger than its lateral (horizontal) dimensions (i.e., widths in dimensions X and Y). Configurations in which housing 12 is shorter in height and wider in width may also be used. If desired, part of housing 12 may be cylindrical and part of housing 12 may have one or more planar sidewalls. For example, housing 12 may have the shape of a half cylinder in which the front portion of housing 12 has a cylindrical shape and the rear portion of housing 12 has a planar rear housing wall. Other shapes with cylindrical surfaces may also be used (e.g., quarter cylinders, three-quarter cylinders, etc.). Display 14 may be mounted in housing 12 or may be omitted from device 10 of FIG. 5.

The illustrative configurations for device 10 that are shown in FIGS. 1, 2, 3, 4, and 5 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, an accessory such as a charging station, a stand for a display, speaker or other electronic device, an alarm clock, a speaker, a docking station, an amplifier, a projector, a camera, a video camera, gaming equipment, a television cable box or other set-top box, lighting equipment, a motion sensor, a touch pad or other input-output device that gathers data from a touch sensor(s), networked attached storage or other data storage device, a wireless access point, a router, or other network equipment, other equipment, or equipment that implements the functionality of two or more of these devices.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 may include display pixels formed from liquid crystal display (LCD) components, organic light-emitting diode pixels, or other suitable image pixel structures. If desired, display 14 may be omitted from device 10 (e.g., to conserve space) or multiple displays such as display 14 may be included in device 10 (e.g., in an array). Light-based status indicators and other input-output devices may be used to supplement information displayed on display 14 or may be used to provide a user with status information and other output when display 14 has been omitted.

If desired, one or more electrical components may be mounted on housing 12. For example, a single component or an array of components may be mounted in the position(s) of illustrative component(s) 34 of FIG. 5 or elsewhere on housing 12 of FIG. 1, 2, 3, 4, or 5 or on other electronic device housings. Electrical components 34 may be mounted on a planar housing wall or a curved housing wall. Components 34 may, for example, be mounted an a surface of housing 12 where housing 12 has a non-planar surface such as where housing wall 12-2 of FIG. 5 is curved (e.g., curved on the side of a cylinder). In general, components 34 may be mounted on a curved surface such as a corner of a housing, a rounded edge of a housing, a curved sidewall, a curved front wall, a curved rear wall of housing 12, a curved top wall, etc. Configurations in which housing 12 has a cylindrical surface on which components 34 are mounted in an array (e.g., configurations of the type shown in FIG. 5 in which components 34 are mounted in an array on some or all of curved cylindrical outer surface 12-2 of housing 12) are sometimes described herein as an example.

The electrical components that are mounted to housing 12 such as components 34 of FIG. 5 may be electrical components such as light-emitting diodes, lamps, displays, lasers, or other light-emitting components, may be vibrators, buzzers, speakers, tone-generators, microphones, or other acoustic components, may be sensors such as touch sensors, temperature sensors, accelerometers, compasses, gyroscopes, position sensors, proximity sensors, or may be other suitable electronic components.

Figure 6:
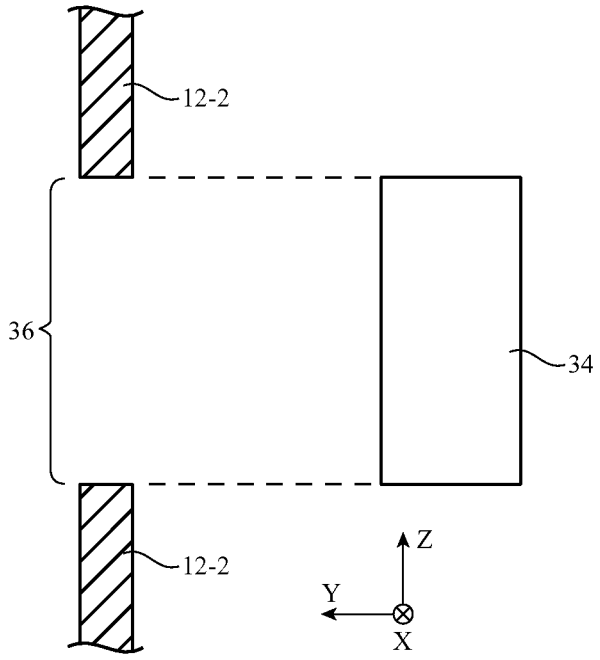
FIG. 6 is a cross-sectional side view of an illustrative electronic component being mounted in an opening in a device housing in accordance with an embodiment.

As shown in FIG. 6, each component 34 may be mounted in a respective opening in housing wall 12-2 such as opening 36. Component 34 may be mounted from the exterior of device 10 or from the interior of housing 12. After component 34 has been placed within opening 36, fasteners or other suitable attachment mechanisms (e.g., clips, adhesive, springs, other engagement features, etc.) may be used in securing component 34 to housing wall 12-2.

Figure 7:
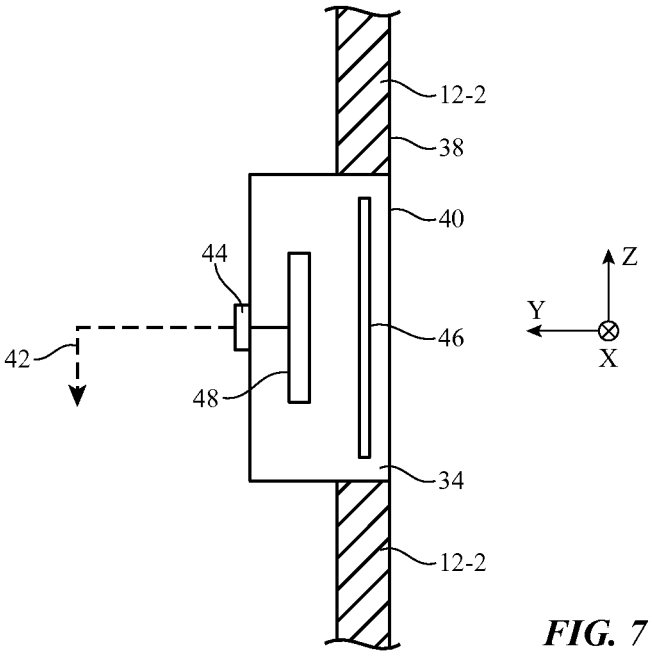
FIG. 7 is a cross-sectional side view of the illustrative electronic component of FIG. 6 following mounting of the component to the device housing in accordance with an embodiment.

As shown in FIG. 7, component 34 may be mounted so that some or all of exterior component surface 40 is flush (or nearly flush) with outer surface 38 of housing wall 12-2. In configurations in which housing wall 12-2 is curved (e.g., when wall 12-2 forms part of a cylinder), external component surface 38 may have a matching curved surface (e.g., some or all of the curvature of surface 40 of component 34 may match (or nearly match) the curvature of housing wall surface 38.

Electrical components 34 may be coupled to control circuitry using signal paths such as signal path 42 of FIG. 7. Signal path 42 may include one or more conductive lines on printed circuits or other substrates, wires, optical fibers, light-pipes, cables, plastic carriers with metal traces or other electrical signal lines, or other signal paths. The electrical and/or optical paths that are coupled to components 34 may be used to carry power signals, digital and/or analog signals (e.g., control signals, image data, audio signals, sensor information, etc.), or other signals.

Connectors such as connector 44 of FIG. 7 may be used to facilitate attachment of the electrical components to signal path 42. For example, components 34 may each have a respective connector such as connector 44 of FIG. 7 that mates with a corresponding connector on an optical and/or electrical cable or other signal path 42. Connector 44 may be a zero insertion force cable or other printed circuit connector, may be a coaxial connector or other rotationally symmetric connector for audio and/or radio-frequency signals, may be a power connector, may be a Universal Serial Bus connector or other digital data connector, may be an Ethernet connector, may be an audio connector, may be an optical connector, may be a male connector, may be a female connector, may be a locking connector, may be an reversible (orientation independent) connector with two or more operating positions, or may be any other suitable connector. If desired, connector 44 may have mating contacts that can be coupled and decoupled without using a fixed connection such as a solder or conductive adhesive connection Alternatively, connections between component 34 and a signal path may be made by using solder or conductive adhesive to join mating contacts (e.g., contacts on components 34 and mating contacts on a cable, printed circuit substrate, or other carrier with metal traces or other electrical signal lines).

Components such as component 34 of FIG. 7 may contain subcomponents such as subcomponents 46 and 48. Subcomponent 46 may be located near the front face of component 34 and may be a lens or lens system (e.g., when component 34 is an optical component), may be a diaphragm or speaker grill (e.g., when component 34 is a speaker), may be a microphone diaphragm, may be an optically or acoustically transparent window structure, may be a dielectric member (e.g., to form a window that allows electromagnetic signals for a sensor to pass through the window), may be a thermally conductive member that allows heat to pass into component 34, or may be other suitable front-of-component subcomponent. Subcomponent 48 may be a light source such as a light-emitting diode, laser, or lamp, may be a light detector such as an image sensor or photodetector, may be a speaker driver (e.g., a driver that drives a diaphragm), may be a temperature sensor such as a solid state temperature sensor or a thermocouple, may be a motion sensor, capacitive sensor, or other type of sensor, or may be other suitable electrical subcomponent for supporting the operation of component 34.

Figure 8:
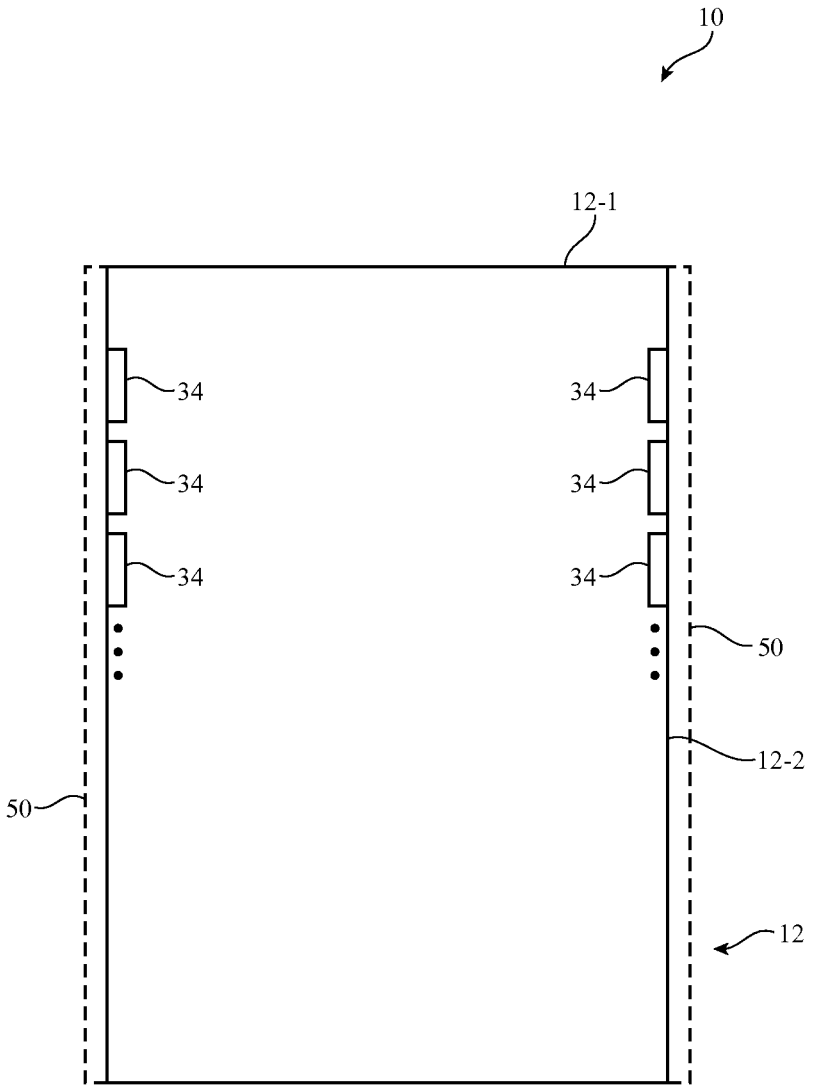
FIG. 8 is a cross-sectional side view of an electronic device showing how an array of components may be mounted to the exterior of a device housing in accordance with an embodiment.

If desired, components 34 may be mounted in a continuous (or nearly continuous) array of rows and columns on the outer curved surface of cylindrical housing wall 12-2, as shown in the illustrative cross-sectional side view of device 10 in FIG. 8. Components 34 may also be mounted on internal housing structures and/or walls such as upper wall 12-1. An optional covering such as covering 50 may be used to cover components 34. Covering 50 may be acoustically transparent (e.g., covering 50 may be a plastic mesh and/or metal mesh or other cover with openings to allow sound to pass), may be optically transparent (e.g., by using a transparent or semi-transparent material or pattern of material such as frosted glass, plastic with a thin semitransparent coating or patterned coating layer), may be sufficiently thermal conductive to allow temperature measurements to be made through covering 50 (e.g., a thin metal cover), or may be any other suitable covering structure for improving device aesthetics, enhancing component protection, etc.

There may be any suitable number of components 34 in the array of components on wall 12-2 (e.g., one or more, two or more, five or more, 10 or more, 20 or more, 50 or more 2-200, 5-150, 20-100, less than 100, less than 50, less than 300, less than 20, 20-70, 20-100, or other suitable number). The distance between adjacent components 34 may be less than 10 mm, 2-5 mm, less than 20 mm, more than 3 mm, between 1-15 mm, less than 5 mm, etc.

Figure 9:
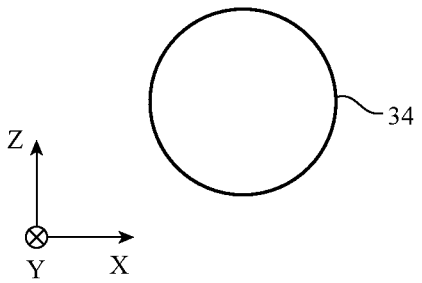
FIG. 9 is a front view of an illustrative electronic component with a circular outline in accordance with an embodiment.
Figure 10:
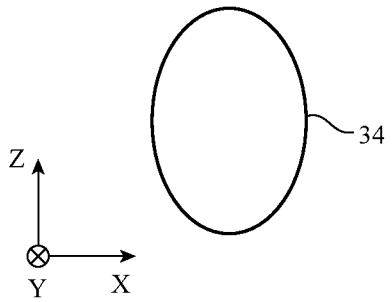
FIG. 10 is a front view of an illustrative electronic component with an oval outline in accordance with an embodiment.
Figure 11:
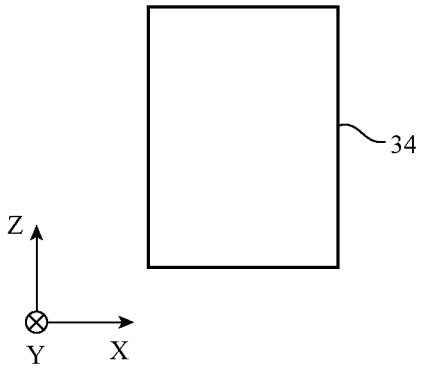
FIG. 11 is a front view of an illustrative electronic component with a rectangular outline in accordance with an embodiment.
Figure 12:
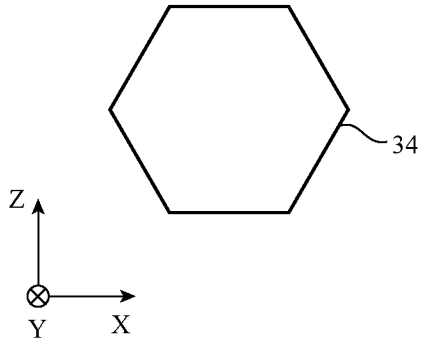
FIG. 12 is a front view of an illustrative electronic component with a hexagonal outline in accordance with an embodiment.

Components 34 may have any suitable shapes such as box shapes, frustoconical shapes (e.g., frustoconical shapes with planar and/or curved ends), pyramidal shapes, shapes with front surfaces that are wider than their opposing rear surfaces, shapes with curved edges and/or straight edges, shapes with curved front surfaces, etc.), cone shapes, stepwise varying cone shapes, spherical shapes, disk shapes, shapes with combinations of curved and straight edges and planar and/or curved sidewalls, etc.). FIGS. 9, 10, 11, and 12 are front views of illustrative shapes that may be used for components 34. In the example of FIG. 9, component 34 has a circular outline when viewed from the front (i.e., when viewed from the exterior of device 10 when component 34 has been mounted in housing sidewall 12-2). In the example of FIG. 10, component 34 has an oval outline when viewed from the front. FIG. 11 shows how component 34 may have a rectangular outline when viewed from the front. In the illustrative configuration of FIG. 12, component 34 has a hexagonal shape when viewed from the front. Other shapes may be used for component 34 if desired. The examples of FIGS. 9, 10, 11, and 12 are merely illustrative.

Figure 13:
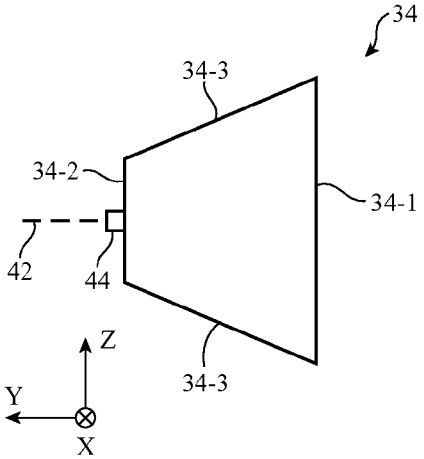
FIG. 13 is a cross-sectional side view of an illustrative electronic component with a trapezoidal cross section in accordance with an embodiment.
Figure 14:
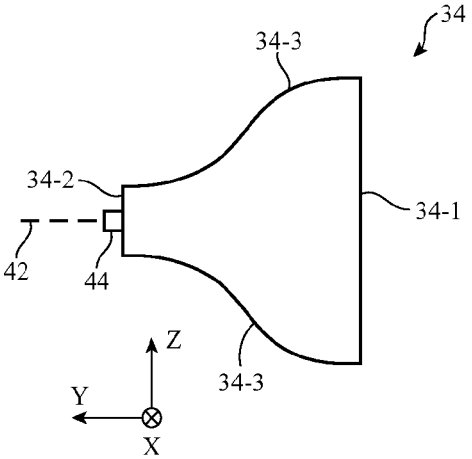
FIG. 14 is a cross-sectional side view of an illustrative electronic component with a smoothly tapered cross section in accordance with an embodiment.
Figure 15:
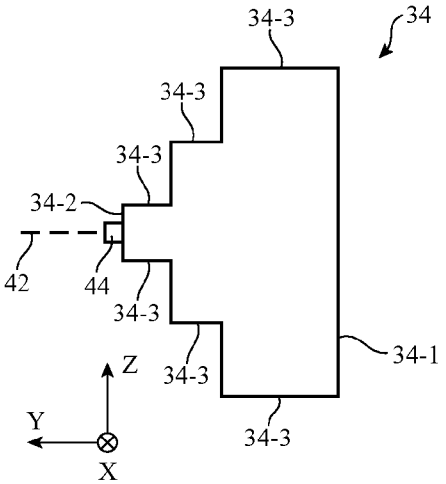
FIG. 15 is a cross-sectional side view of an illustrative electronic component with a cross section that is tapered in a step-wise fashion in accordance with an embodiment.
Figure 16:
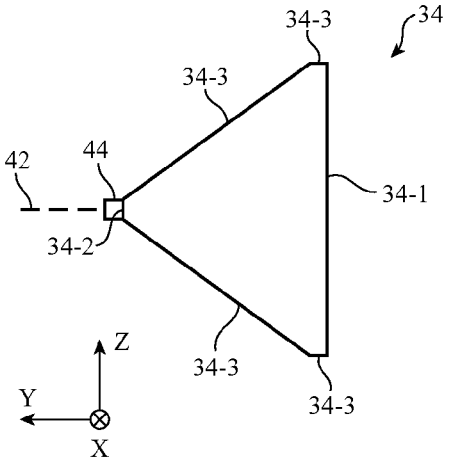
FIG. 16 is a cross-sectional side view of an illustrative electronic component with a cross section that is triangular in shape and has untapered portions in accordance with an embodiment.

Cross-sectional side views of components 34 of different illustrative shapes are shown in FIGS. 13, 14, 15, and 16. As shown in FIG. 13, component 34 may have a front face such as front face 34-1, an opposing rear face such as rear face 34-2, and side surfaces such as surfaces 34-3. Some or all of front face 34-1 may lie flush with outer surface 38 of housing 12-2 (i.e., front face 34-1 of component 34 may form exterior surface 40 of FIG. 7). In the example of FIG. 13, front face 34-1 has larger lateral dimensions (in vertical dimension Z and horizontal dimension X) than rear face 34-2. Side surfaces 34-3 form a tapering shape so that component 34 is wider at the front than at the rear. Side surfaces 34-3 are straight in the cross-sectional side view of FIG. 13. In the illustrative configuration of FIG. 14, side surfaces 34-3 have smoothly tapering curved profiles. FIG. 15 shows how side surfaces 34-3 may progressively narrow component 34 in a step-wise fashion. In the example of FIG. 16, side surfaces 34-3 have portions in which component 34 does not taper and portions in which component 34 tapers. Connector 44 may be mounted on rear surface 34-2 of component 34 or elsewhere in component 34. If desired, other side profiles may be used for component 34 (e.g., tapered and/or non-tapered profiles). The configurations of FIGS. 13, 14, 15, and 16 are shown as examples.

Figure 17:
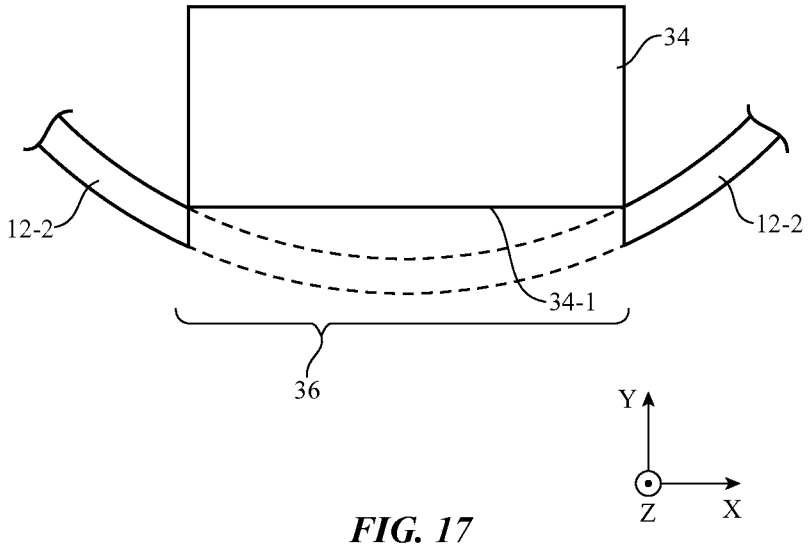
FIG. 17 is a top view of an illustrative component with a flat outer surface that has been mounted in an opening in a cylindrical housing in accordance with an embodiment.
Figure 18:
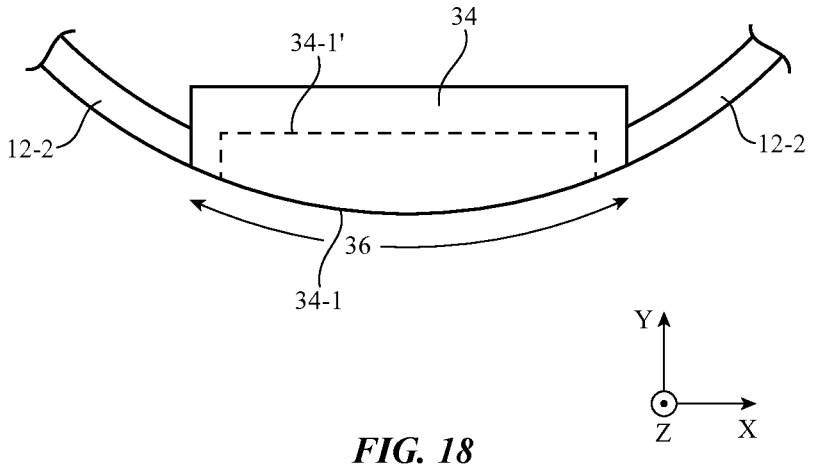
FIG. 18 is a top view of an illustrative component with a curved outer surface that has been mounted in an opening in a cylindrical housing in accordance with an embodiment.

It may be desirable to provide front face 34-1 of component 34 with a surface shape that matches the surface shape of housing wall 12-2. For example, if housing wall 12-2 has a cylindrical shape with a curved (circular) outer surface, component 34 may have a matching curved outer surface. FIG. 17 is a top view of an illustrative configuration in which component 34 has a front surface (surface 34-1) that is planar. As a result, surface 34-1 does not match the curvature of the curved outer surface of cylindrical housing wall 12-2. FIG. 18 shows how component 34 may be provided with a curved outer surface (surface 34-1) that matches the curved outer surface of cylindrical housing wall 12-2. If desired, peripheral edges of surface 34-1 or other portion of surface 34-1 may match the curved surface of cylindrical housing wall 12-2 and other portions (e.g., central portion 34-1') may have other surface shapes (e.g., protruding and/or recessed shapes, planar shapes, dome-shaped configurations, etc.).

Figure 19:
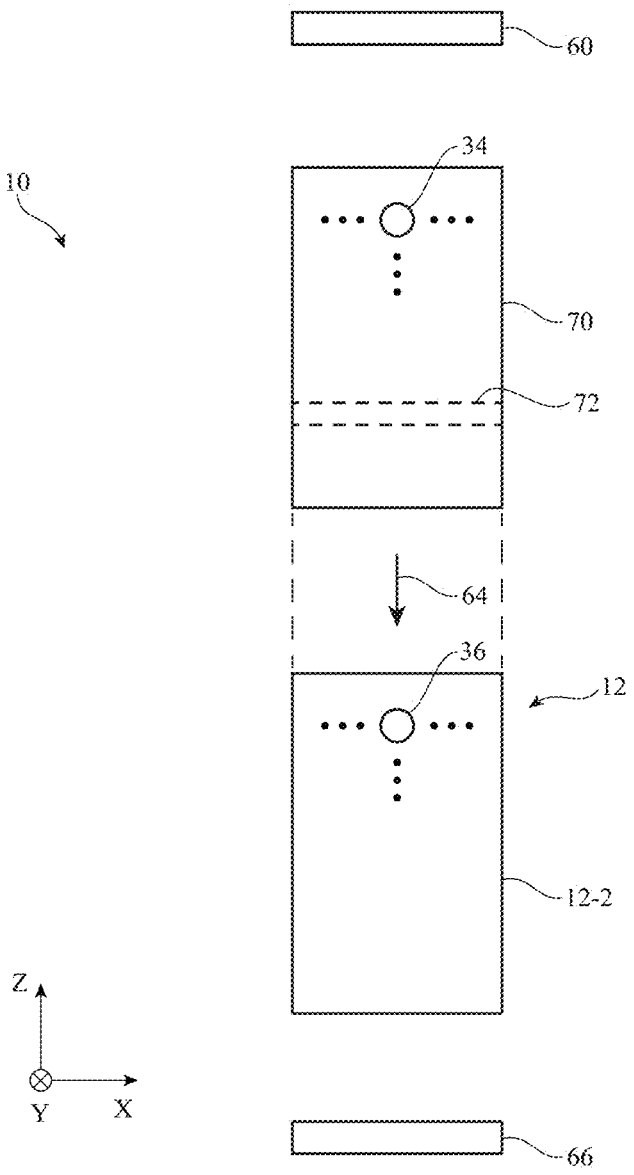
FIG. 19 is an exploded view of an illustrative electronic device containing radially deployed components in accordance with an embodiment.

FIG. 19 is an exploded view of device 10 in an illustrative configuration in which an inner support structure such as support structure 70 is used to support one or more components 34 within housing 12. As shown in FIG. 19, components 34 may, if desired, by formed in an array on the surface of support structure 70 in a pattern that matches an array of openings 36 in housing wall 12-2 of housing 12. Support structure 70 may have a shape that allows support structure 70 and components 34 to be mounted within the interior of housing 12. If, for example, housing 12 has a cylindrical shape or other shape with curved walls 12-2, support structure 70 may have a corresponding cylindrical shape or other shape with matching curved walls. Configurations in which housing 12 and/or support structure 70 have box shapes or other shapes with planar walls may also be used.

The dimensions of support structure 70 may be smaller than the interior dimensions of housing 12 to allow support structure 70 and components 34 to be installed within housing 12. For example, in configurations in which housing 12 is cylindrical in shape, the inner diameter of housing 12 may be larger than the outer diameter of structure 70 and components 34 to ensure that structure 70 and components 34 can be inserted into the interior of housing 12 in direction 64 (e.g., along the longitudinal axis of elongated structures such as housing 12 and support structures 70 of FIG. 19).

If desired, structure 70 may have a hollow interior. One or more inner wall structures such as wall 72 may be used as baffles to separate the interior of structure 70 into separate cavities or inner wall structures such as wall 72 may be omitted. Components such as components 60 and 66 may be mounted to the upper and lower ends of structure 70 and housing 12. Components 60 and 66 may be light-based components such as lamps, light-emitting diodes, or displays, may be input-output components such as buttons or touch sensors, may be input-output ports, may be speakers, microphones, or other audio components, may be printed circuit boards containing integrated circuits and other circuitry, or may be other electrical components. As shown in FIG. 19, component 60 may be installed in the upper end of device 10 (e.g., component 60 may be mounted within an open upper end in a cylindrical inner structure such as structure 70 using a sealed or unsealed mounting arrangement). Component 66 may be installed in the lower end of device 10 (e.g., component 66 may be mounted within an open lower end in a cylindrical inner structure such as structure 70 using a sealed or unsealed mounting arrangement).

Components 34 may be mounted in openings 36 using threaded mounting arrangements, using press-fit attachment techniques, using adhesive, screws and nuts, or other mechanical fastening techniques, using component deployment structures that press components 34 radially outward into openings 36, or using other suitable component mounting structures. Once installed, control circuitry in device 10 can gather signals from components 34 and/or may provide signals to components 34. The control circuitry may include integrated circuits, memory, microprocessors, microcontrollers, application-specific integrated circuits (e.g., audio circuits and/or video circuits, sensor processing circuits, display driver circuits, etc.), audio drivers, or other suitable control circuitry. In some arrangements, the control circuitry may both supply output signals to components 34 and receive input signals from components 34. In other arrangements, the control circuitry may only supply output signals to components 34 or may only supply input signals to components 34.

In some applications, such as applications in which each of the components 34 in an array of components in device 10 is to be operated independently, it may be desirable to route signals to and/or from each component 34 separately. In this way, data may be gathered independently from each sensor in an array of sensor-based components, light output can be adjusted independently for each light-emitting diode or other light source in an array of light-based components, or audio data can be output (or received) by independently controlling audio components (e.g., independently controlled speakers in an array of speakers, independently controlled microphones in an array of microphones, etc.).

Signal paths between the control circuitry of device 10 and each component 34 may be provided using metal traces on a dielectric substrate or other support structure, using stamped metal foil with a desired pattern of metal lines, using wires, using portions of a device housing, using machined metal parts (e.g., brackets), using screws, using springs and other metal structures, or using other conductive signal path structures. Metal traces can be formed by depositing a blanket layer of metal (e.g., aluminum, copper, etc.) followed by photolithographic patterning or other patterning techniques, can be formed by evaporating or sputtering metal through a shadow mask, may be formed by ink jet printing of metallic paint (ink), may be formed by screen printing of metal paint (e.g., silver paint to form silver lines), or may be formed using other deposition and/or patterning techniques.

Examples of dielectric substrates include printed circuits (e.g., rigid printed circuit boards formed from fiberglass-filled epoxy or other rigid printed circuit board material, flexible printed circuits formed from flexible polyimide sheets, polyethylene terephthalate (PET) sheets, or other layers of flexible polymer), molded or machined pieces of plastic that serve as dielectric carriers, glass, ceramic, sapphire, or other dielectric materials. Configurations in which electrical components 34 are interconnected using signal paths such as metal traces in printed circuits are sometimes described herein as an example.

Electrical components 34 may be mounted to a rigid support structure. For example, electrical components 34 may be mounted in openings 36 in housing wall 12-2 of housing 12 or to structures that are rigidly attached to housing 12. A component interconnect substrate such as printed circuit 80 of FIG. 20 may then be used to provide signal paths through which signals for electrical components 34 and other components may be conveyed. Printed circuit 80 may be a rigid printed circuit board or a flexible printed circuit. Printed circuit 80 may have an elongated strip shape (e.g., the shape of an elongated rectangle) or may have other suitable shapes. Elongated shapes may allow printed circuit 80 to form connections to one or more, two or more, or 10 or more components 34 in a single row or column. If desired, printed circuit 80 may also be used to form connections for a two-dimensional array of components 34 (e.g., an array in which multiple components 34 extend in different directions to form both rows and columns).

Figure 20:
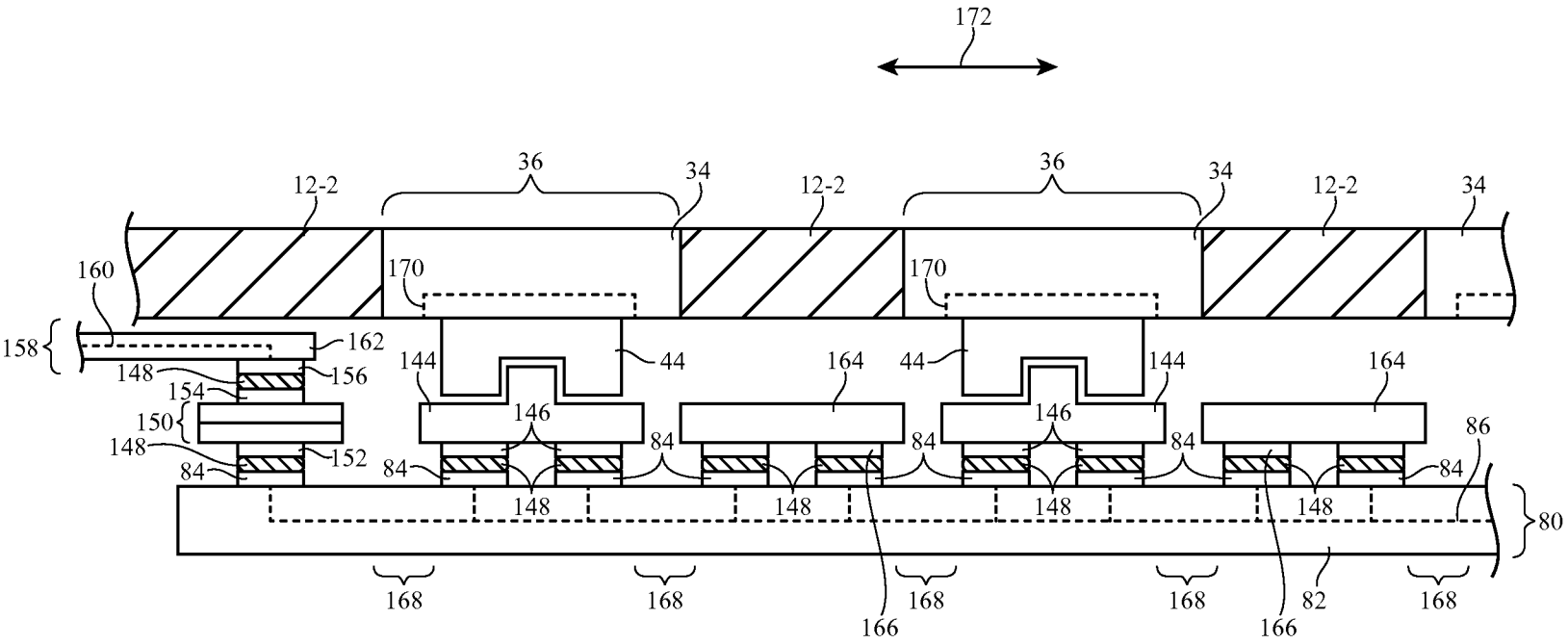
FIG. 20 is a cross-sectional side view of an illustrative configuration in which electrical components are coupled to signal paths in a printed circuit in accordance with an embodiment.

As shown in FIG. 20, printed circuit 80 may include metal traces 86. Metal traces 86 can be formed in a single layer (e.g., the outer surface) of printed circuit substrate 82 (e.g., to minimize cost and complexity) or may be configured to form multiple layers of signal lines interconnected by vias (e.g., lines in a multilayer printed circuit).

Metal traces 86 may be patterned to from contacts 84 (sometimes referred to as contact pads or printed circuit contacts). Dielectric substrate 82 may be a flexible layer of polymer such as a polyimide layer or a layer of rigid printed circuit board material (as examples). Connectors such as connectors 144 may be mounted to printed circuit 80 and may be coupled to respective electrical component connectors 44 on electrical components 34. Connectors 144 may have contacts (contact pads) such as contacts 146. Solder 148 may be used to form solder joints between contacts 146 of connectors 144 and mating contacts 84 on printed circuit 80. There may be any suitable number of contacts 146 for each connector 144 (e.g., each connector 144 may have a pair of contacts 146, may have three or more contacts 146, or may have any other suitable numbers of contacts 146).

If desired, electrical components such as components 164 (e.g., integrated circuits) may be mounted to printed circuit 80. Components 164 may have contacts 166 that are soldered to mating contacts 84 on printed circuit 80 using solder 148. Components 164 may be signal drivers for light-based components such as display driver integrated circuits, drivers for light-emitting diodes, or control circuits for other light-based components, may be audio circuits such as audio circuits that receive and process signals from microphones or audio integrated circuits (e.g., speaker driver integrated circuits or other audio circuits) for amplifying audio signals or otherwise processing signals on paths 76 before providing these amplified signals to components 34, may be sensor signal processing circuits (e.g., touch sensor integrated circuits, proximity sensor integrated circuits, etc.), may be discrete components (e.g., one or more inductors, capacitors, or resistors), or may be other electrical components. There may be one component 164 (or one set of multiple components 164) between each respective pair of adjacent connectors 144 or other patterns of components 164 and connectors 144 may be soldered to printed circuit 80. The configuration of FIG. 20 is merely illustrative.

Using the signal paths formed from metal traces 86, printed circuit 80 may be used to convey signals between electrical components 34 and electrical components 164. The signal paths of printed circuit 80 may also be interconnected with other circuitry in device 10 using signal path structures such as printed circuit 158. As shown in FIG. 20, a connector such as printed circuit connector 150 may be mounted on printed circuit 80.

Connector 150 may have contacts such as contact 152 that are soldered to respective contacts 84 on printed circuit 80 using solder 148. Connector 150 may also have contacts such as contact 154 that are soldered with solder 148 to contacts on printed circuit 158 such as contact 156. Printed circuit 158 may have a dielectric substrate such as substrate 162 (e.g., a flexible printed circuit substrate for a flexible printed circuit or a rigid printed circuit board substrate for a rigid printed circuit board). Metal traces 160 may be formed in substrate 162. Metal traces 160 include portions that form contacts such as contact 156 that are soldered to contacts on connector 150 such as contact 154. This couples the signal paths of printed circuit 158 to connector 150. Connector 150 may be a printed circuit connector such as a board-to-board connector or other connector that couples metal traces 160 of printed circuit 158 to metal traces 86 in printed circuit 80. Printed circuit 158 may couple printed circuit 80 to circuitry on a printed circuit (e.g., a main logic board) or other circuitry in device 10. For example, printed circuit 158 may couple components 164 and 34 to analog and/or digital circuitry on one or more printed circuits mounted in housing 12.

The support structure to which components 34 are mounted (i.e., housing wall 12-2 in the example of FIG. 20) may be rigid. Because housing wall 12-2 is rigid, the positions of components 34 (and therefore connectors 44 of components 34) are fixed and are unable to shift laterally with respect to each other along lateral dimensions such as lateral dimension 172. To help ensure that connectors 144 on printed circuit 80 can mate successfully with connectors 44, device 10 may be provided with lateral shift accommodation structures. These structures may accommodate slight shifts in position of connectors 144 relative to connectors 44 during assembly, so that printed circuit 80 may be mated with the array of components 34 mounted to housing wall 12-2.

With one suitable arrangement, lateral shift accommodation structures such as structures 170 are interposed between the portions of components 34 mounted to rigid housing wall 12-2 and electrical component connectors 44. Structures 170 may be formed as integral portions of components 34 or as separate structures that are attached to other structures in components 34 using screws, adhesive, or other attachment mechanisms. Structures 170 may be sufficiently flexible to accommodate shifts in position along dimensions such as dimension 172 during manufacturing when connectors 144 on printed circuit 80 are being connected to mating connectors 44. If, for example, one of components 34 is located slightly out of its expected position due to a manufacturing variation related to the position of the opening 36 in which that component 34 is mounted, structure 170 can allow connector 44 to shift in position slightly (i.e., back to the original expected position). Manufacturing variations that affect the locations at which connectors 144 are soldered to printed circuit 80 can likewise be accommodated using lateral shift accommodation structures 170.

With another suitable arrangement, lateral shifts may be accommodated using lateral shift accommodation structures formed in printed circuit 80. As an example, regions of printed circuit 80 that surround each connector 144 such as regions 168 of FIG. 20 may be provided with elongated slots or other openings that pass through printed circuit substrate 82. These openings create locally enhanced regions of flexibility in printed circuit 80 and allow the portions of printed circuit 80 to which connectors 144 are mounted to shift laterally with respect to rigidly mounted components 34 and associated connectors 44. The regions of printed circuit 80 that contain the openings may sometimes be referred to as lateral shift accommodation structures because they accommodate lateral shifts in the relative positions of connectors 144 and connectors 44 during assembly operations.

If desired, lateral shifts in the relative positions between connectors 44 and connectors 144 may be accommodated using both lateral shift accommodation structures 170 and lateral shift accommodation structures 168 or using other types of lateral shift accommodation structures. Because lateral shift accommodation structures allow variations in the relative positions of connectors 144 and 44 to be accommodated, these structure may sometimes be referred to as relative position shift accommodation structures, lateral movement accommodation structures, or lateral misalignment accommodation structures.

Figure 21:
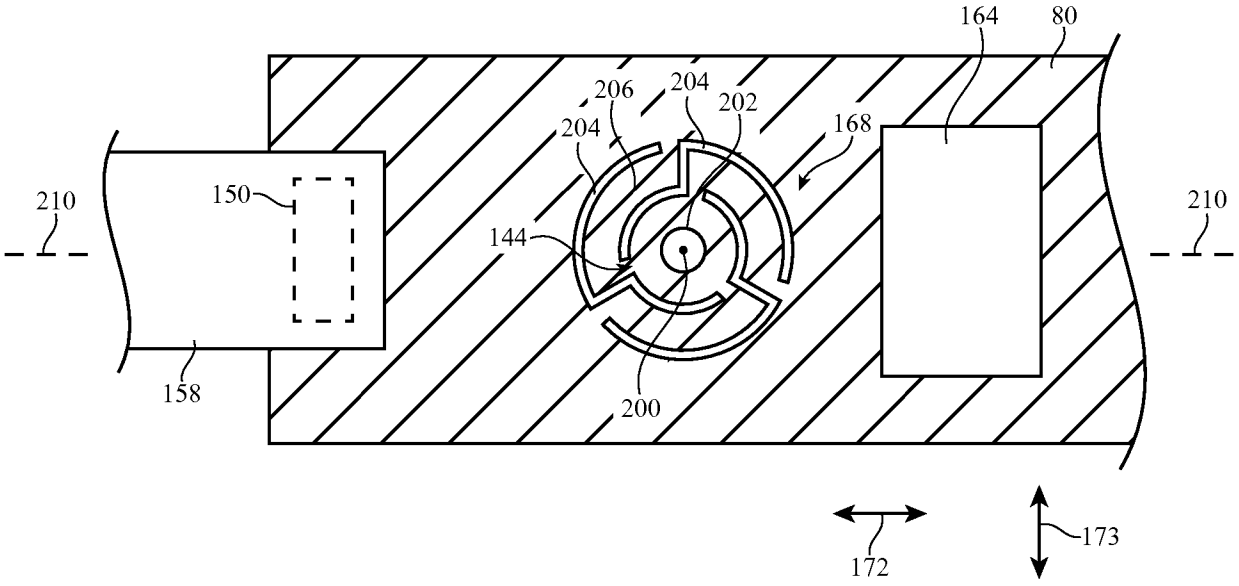
FIG. 21 is a top view of a connector surrounded by openings in a printed circuit that form a lateral shift accommodation structure in accordance with an embodiment.

FIG. 21 is a top view of a portion of printed circuit 80 in which connector 144 has been surrounded by curved slots forming lateral shift accommodation structures 168. As shown in FIG. 21, connector 144 may have terminals such as inner terminal 200 and outer terminal 202. Terminals 200 and 202 may be rotationally symmetric so that connector 144 can accommodate rotational misalignment with respect to connector 44 on electrical component 34. Other types of connector may be used in implementing connector 144 if desired (e.g., rectangular connectors and other connector that do not accommodate rotational misalignment between connectors 144 and 44).

As shown in FIG. 21, structure 168 may be formed from openings 204 that surround connector 144. Sufficient material such as material 206 remains in the spaces between openings 204 to support connector 144. Material 206 forms flexible structures that can flex during assembly operations. Sufficient material has been removed from printed circuit 80 to ensure that connector 144 can shift in lateral dimensions 172 and 173 to accommodate mating of connectors 144 to corresponding connectors 44 on components 34. As shown in FIG. 21, printed circuit 80 may be elongated along a longitudinal axis 210. When assembled into device 10, axis 210 may wrap horizontally around housing 12 (e.g., around the inner surface of housing 12 of FIG. 19), may extend vertically (in dimension Z) along the inner surface of wall 12-2, or may be mounted in other orientations (e.g., diagonally, etc.). One or more printed circuits such as printed circuit 158 may be coupled to printed circuit 80 using connectors such as connector 150. Components such as component 164 may be mounted along the length of printed circuit 80. For example, components 164 may be mounted to printed circuit 80 at locations between respective adjacent connectors 144.

Figure 22:
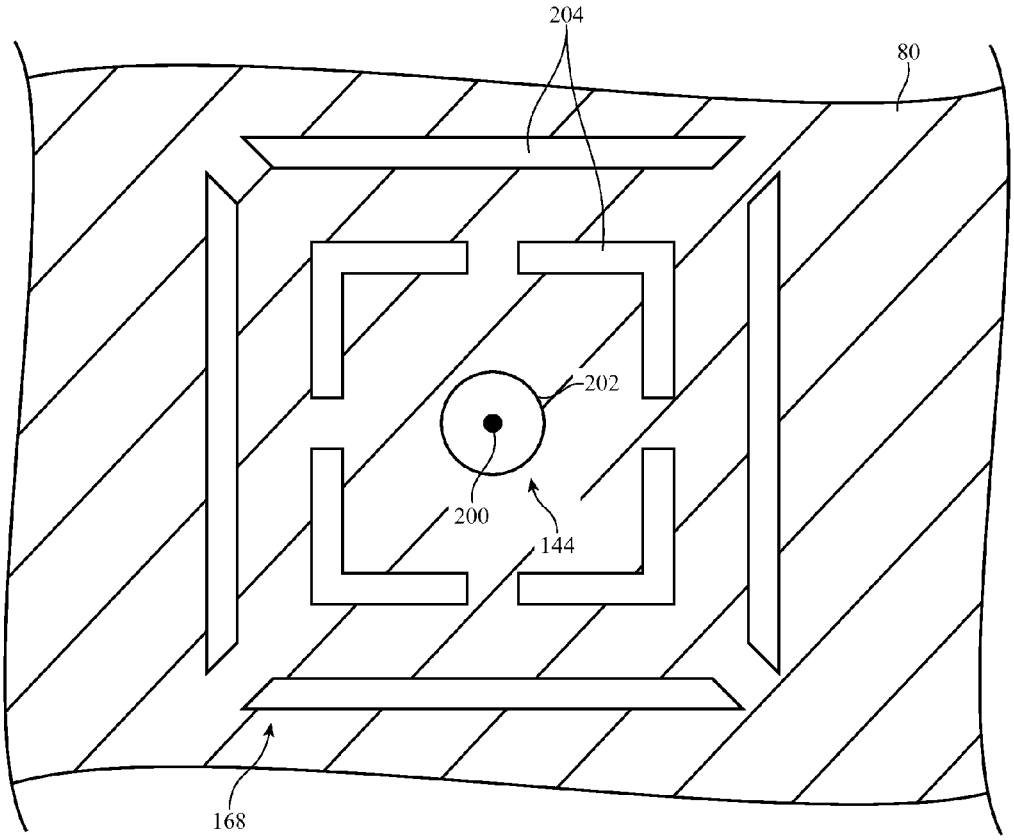
FIG. 22 is a top view of a connector surrounded by horizontally and vertically extending openings that form a lateral shift accommodation structure in accordance with an embodiment.

Structures 168 and openings 204 may lie within an annular area or other region that surrounds connector 144, may have configurations in which openings 204 are interposed between connector 144 and components 164 (e.g., configurations in which structures 168 do not completely surround connectors 144), and may have other suitable shapes. In the illustrative configuration shown in the top view of printed circuit 80 of FIG. 22, lateral shift accommodation structures 168 have been formed from elongated slot-shaped openings 204 that run horizontally and vertically. Other layouts for openings 204 may be used in forming flexible structures such as lateral shift accommodation structures 168, if desired. The illustrative arrangements of FIGS. 21 and 22 are merely illustrative.

Figure 23:
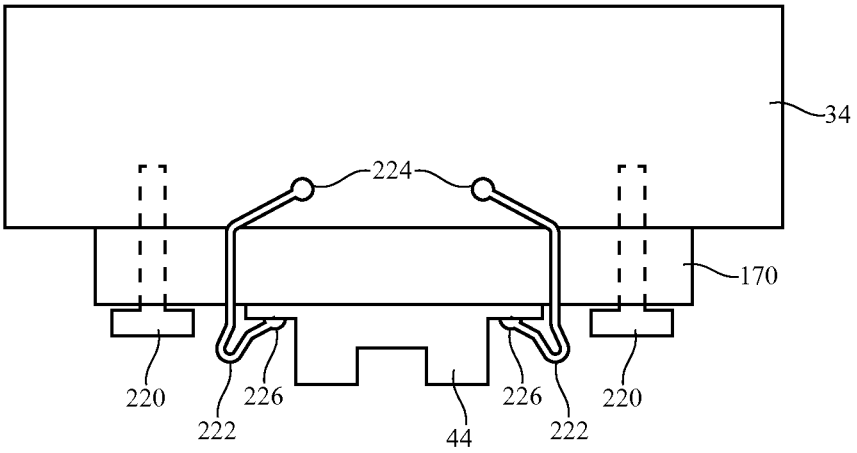
FIG. 23 is a cross-sectional side view of an illustrative connector mounted to a component using a lateral shift accommodation structure in accordance with an embodiment.

FIG. 23 is a cross-sectional side view of an illustrative electrical component 34 to which a lateral shift accommodation structure such as structure 170 of FIG. 20 has been mounted. Structure 170 of FIG. 23 has been attached to electrical component 34 using screws 220. Screws 220 may have threaded shafts that are received within mating threaded openings in component 34, nuts may be used with screws 220 to secure structure 170 to component 34, or adhesive, welds, or other fastening arrangements may be used to secure structure 170 to component 34.

Electrical component 34 may have terminals such as terminals 224 (e.g., one or more terminals, two or more terminals, ten or more terminals, etc.). Terminals 224 on electrical component 34 may be coupled to mating terminals 226 on connector 44 using signal paths 222. Signal paths 222 may be formed from wires that are soldered to terminals 224 and terminals 222 or may be formed from other suitable conductive structures for electrically coupling connectors 44 to electrical components 34.

Figure 24:
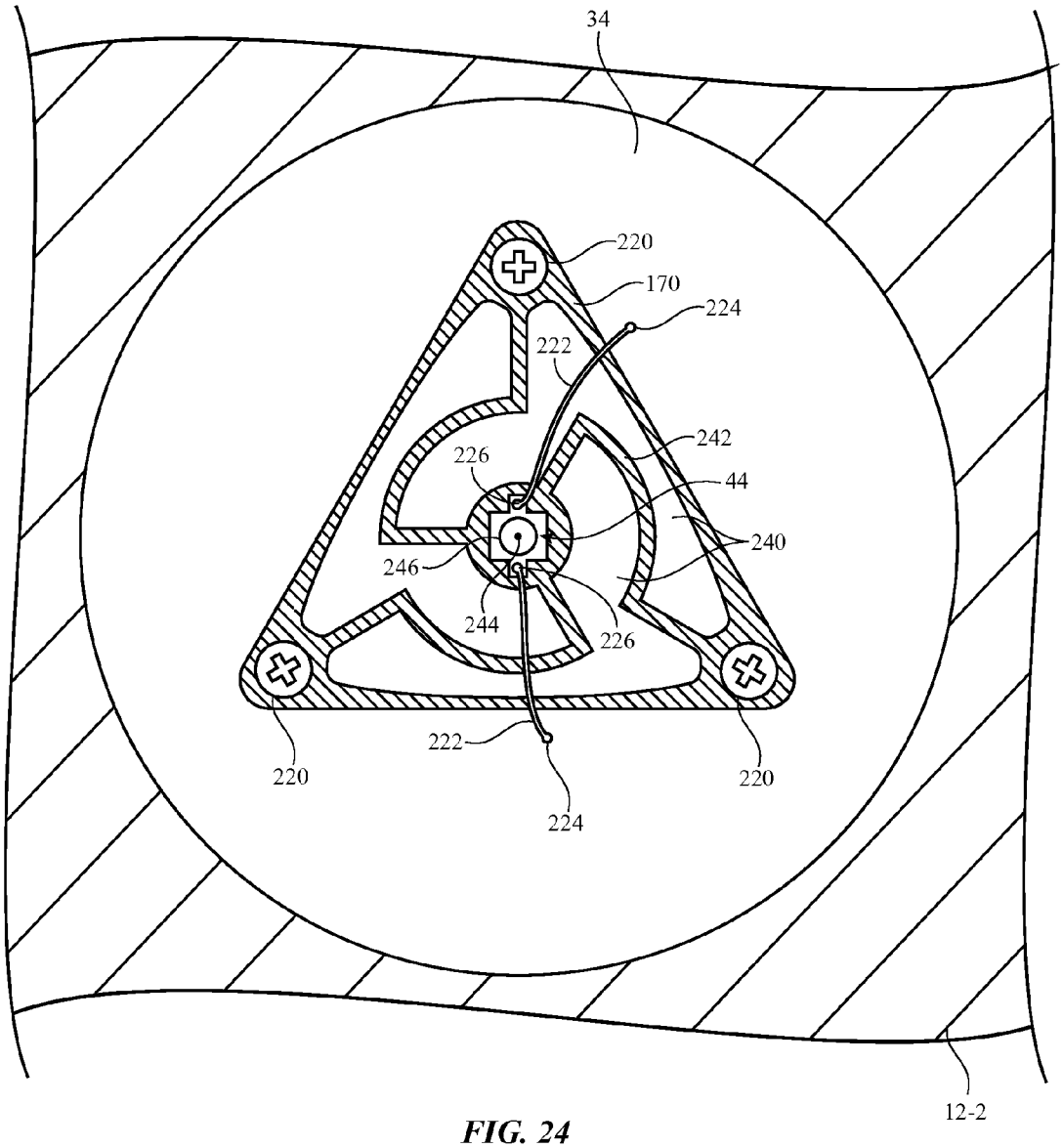
FIG. 24 is a top view of an illustrative lateral shift accommodation structure attached to an electrical component that is mounted to a rigid support structure such as a housing wall in accordance with an embodiment.

A top view of an illustrative configuration that may be used for lateral shift accommodation structure 170 is shown in FIG. 24. In the example of FIG. 24, structure 170 has openings 240 that separate respective structures such as curved members 242 from each other and provide structure 170 with sufficient flexibility to move laterally when need to accommodate attachment of connector 44 to connector 144 on printed circuit 80. Support structures 242 may be formed from plastic, metal, or other material that is flexible enough to allow connector 44 to shift position laterally during assembly of device 10. During lateral movement of connector 44, wires 222 may bend without becoming detached from terminals 224 and 226.

Connector 44 may have a shape that allows connector 44 to mate with connector 144 on printed circuit 80. For example, if connector 44 has a square shape with a pair of terminals, connector 144 may have a mating shape with a corresponding pair of terminals. In the illustrative configuration of FIG. 24, connector 44 has a circular shape with inner and outer terminals such as inner terminal 244 and outer terminal 246. Circular connectors such as circular connector 44 of FIG. 24 may mate with corresponding circular connectors 144 (see, e.g., connector 144 of FIG. 21). Because circular connectors such as these are rotationally symmetric, connectors 44 and 144 can make satisfactory electrical connections regardless of the rotational orientation of connector 44 to connector 144.

Figure 25:
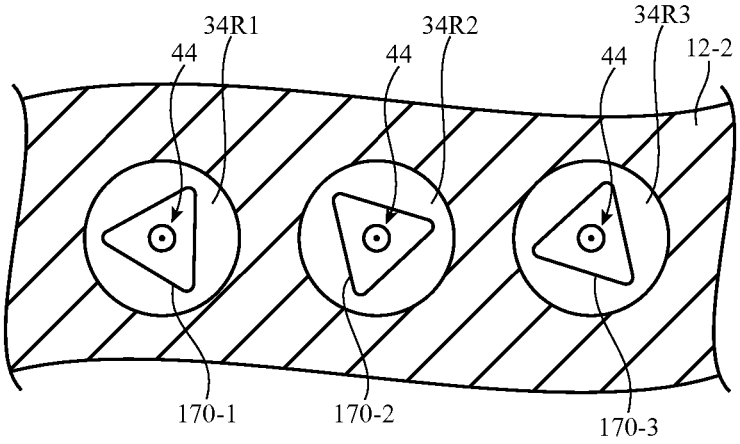
FIG. 25 is a top view of a portion of an illustrative rigid support structure such as a housing wall in which an array of electrical components have been mounted showing how each component may have an electrical connector that is coupled to a lateral shift accommodation structure in accordance with an embodiment.

Consider, as an example, the arrangement shown in FIG. 25. In the example of FIG. 25, three components 34R1, 34R2, and 34R3 have been mounted in respective openings in housing wall 12-2. Components 34R1, 34R2, and 34R3 have circular outlines and have become rotationally misaligned with respect to each other as part of the process of being mounted to housing wall 12-2 (i.e., each of these components is rotated about its connector 44 by a different amount). Lateral shift accommodation structures 170-1, 170-2, and 170-3 have been attached to components 34R1, 34R2, and 34R3, respectively (e.g., using screws 220). Due to the different rotational positions of components 34R1, 34R2, and 34R3 of FIG. 25, the rotational positions of structures 170-1, 170-2, and 170-3 are each different. Nevertheless, because of the rotational symmetry of connectors 44 and 144, each electrical component connector 44 may be satisfactorily connected to a corresponding connector 144 on printed circuit 80.

Figure 26:
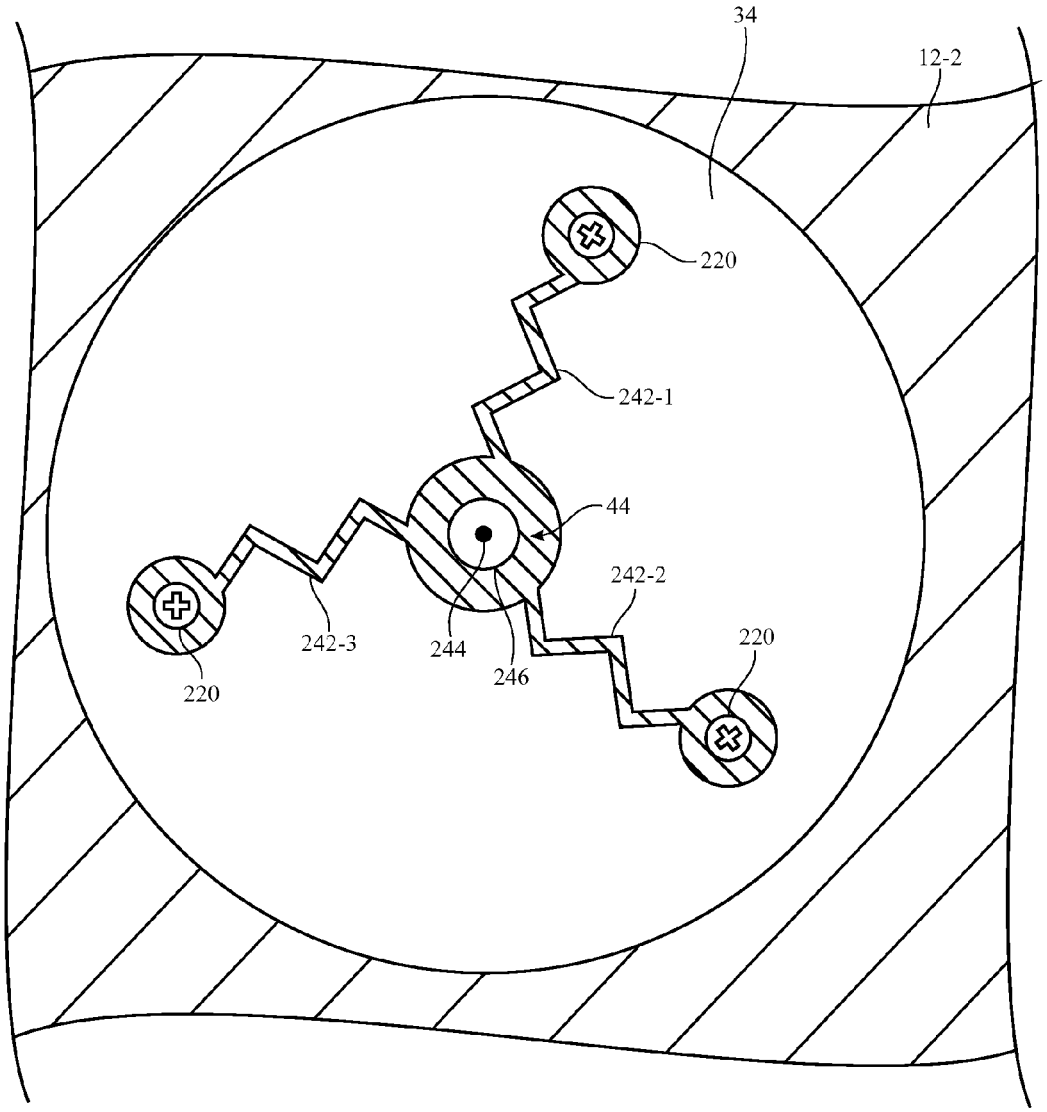
FIG. 26 is a top view of an illustrative connector mounted to a component using a lateral shift accommodation structure having radially extending meandering arms in accordance with an embodiment.
Figure 27:
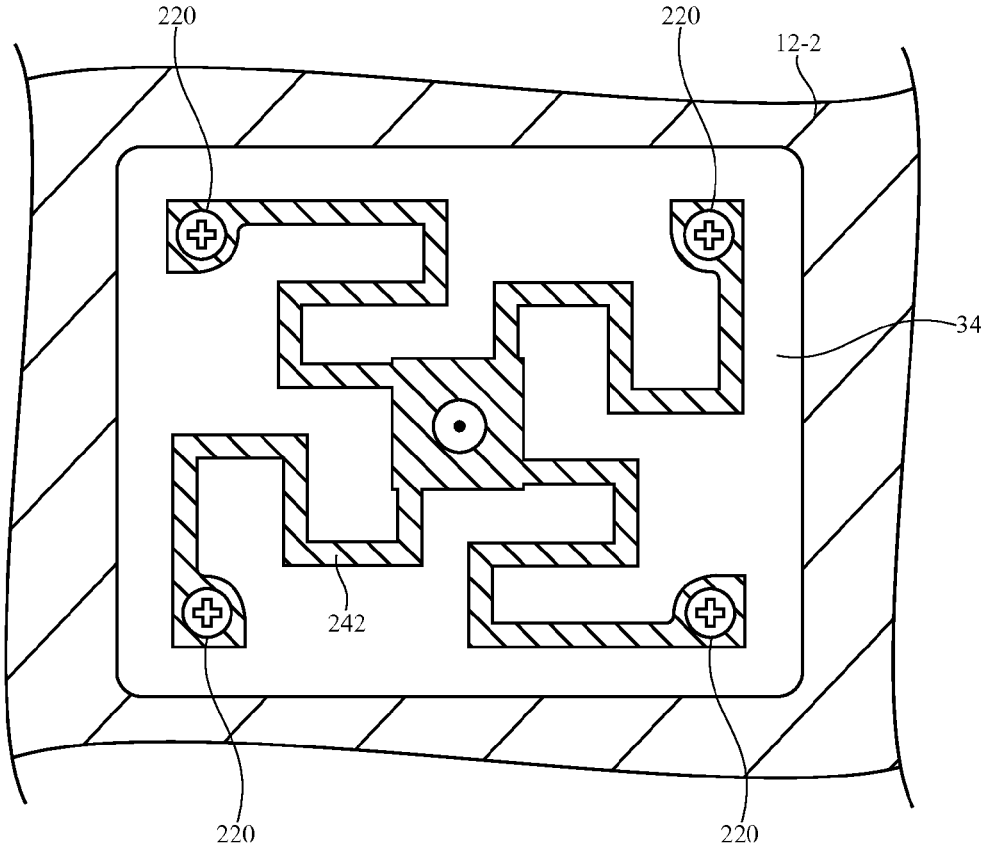
FIG. 27 is a top view of an illustrative connector mounted to a component using a lateral shift accommodation structure with horizontal and vertical members in accordance with an embodiment.

In the example of FIGS. 26 and 27, structure 170 has a triangular outline and is secured using three screws 220. Other configurations may be used for structure 170 if desired. FIG. 26 shows how structure 170 may have three radially extending arms 242-1, 242-2, and 242-3 with meandering shapes (e.g., zig-zag shapes). In the illustrative configuration of FIG. 27, structure 170 is secured to electrical component 34 (i.e., a rectangular component) using four screws 220 and has support members 242 that run horizontally and vertically. Other arrangements may be used for forming structure 170 if desired. The illustrative configurations of FIGS. 24, 26, and 27 are merely illustrative.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

a support structure;

electrical components mounted to the support structure, wherein each of the electrical components has a connector; and a printed circuit to which connectors are mounted, wherein each of the connectors on the printed circuit mates with a corresponding one of the connectors of the electrical components and wherein the printed circuit has openings that form lateral shift accommodation structures that allow the connectors on the printed circuit to shift position relative to the connectors of the electrical components as the connectors on the printed circuit mate with the connectors of the electrical components.

2. The apparatus defined in claim 1 wherein the support structure comprises an electronic device housing.

3. The apparatus defined in claim 2 wherein the electronic device housing has openings and wherein the electrical components are mounted in the openings.

4. The apparatus defined in claim 3 wherein the connectors mounted to the printed circuit are rotationally symmetric.

5. The apparatus defined in claim 4 wherein the electrical components have circular outlines and wherein the openings are circular.

6. The apparatus defined in claim 5 wherein the electrical components comprise components selected from the group consisting of: light sources, light detectors, speakers, and sensors.

7. The apparatus defined in claim 6 further comprising integrated circuits selected from the group consisting of: control circuits that control light-based components and audio circuits.

8. The apparatus defined in claim 7 wherein each integrated circuit is mounted to the printed circuit between a respective pair of the connectors mounted to the printed circuit.

9. The apparatus defined in claim 8 wherein the printed circuit comprises a rigid printed circuit board.

10. The apparatus defined in claim 6 wherein the printed circuit comprises an elongated printed circuit that extends along a surface of the electronic device housing.

11. The apparatus defined in claim 10 wherein the electronic device housing comprises a cylindrical housing.

12. Apparatus, comprising:

a support structure;

electrical components mounted to the support structure;

electrical component connectors each of which is electrically coupled to a respective one of the electrical components;

lateral shift accommodation structures each of which is mounted to a respective one of the electrical components and each of which supports a respective one of the electrical component connectors; and a printed circuit to which connectors are mounted, wherein each of the connectors on the printed circuit mates with a corresponding one of the electrical component connectors and wherein the lateral shift accommodation structures allow the electrical component connectors to shift position relative to the connectors on the printed circuit as the electrical connector components mate with the connectors on the printed circuit.

13. The apparatus defined in claim 12 wherein the lateral shift accommodation structures comprises structures that flex to accommodate shifts in position of the electrical component connectors relative to the connectors on the printed circuit.

14. The apparatus defined in claim 13 wherein the support structure comprises an electronic device housing having a housing wall with openings and wherein the electrical components are mounted in the openings.

15. The apparatus defined in claim 14 wherein the electrical component connectors are rotationally symmetric, wherein the electrical components have circular outlines, and wherein the openings are circular.

16. The apparatus defined in claim 15 wherein the electrical components comprise components selected from the group consisting of: light sources, light detectors, speakers, and sensors.

17. The apparatus defined in claim 16 further comprising integrated circuits selected from the group consisting of: control circuits that control light-based components and audio circuits and wherein each integrated circuit is mounted to the printed circuit between a respective pair of the connectors mounted to the printed circuit.

18. The apparatus defined in claim 17 wherein the printed circuit comprises an elongated rigid printed circuit board that extends along an inner surface of the electronic device housing, wherein the electronic device housing is cylindrical, and wherein the apparatus further comprises screws that attach the lateral shift accommodation structures to the electrical components.

19. An electronic device, comprising:

an electronic device housing wall having openings;

electrical components mounted in the openings and having electrical component connectors;

a printed circuit board to which connectors are mounted, wherein each of the connectors mounted to the printed circuit board mates with a corresponding one of the electrical component connectors; and lateral shift accommodation structures that flex to allow the connectors mounted to the printed circuit board to mate with the electrical component connectors.

20. The electronic device defined in claim 19 further comprising integrated circuits mounted on the printed circuit board.

21. The electronic device defined in claim 20 wherein the lateral shift accommodation structures are interposed between the electrical components and the electrical component connectors.

22. The electronic device defined in claim 20 wherein the lateral shift accommodation structures comprises flexible structures formed by openings in the printed circuit board in the vicinity of each connector mounted to the printed circuit board.

* * * * *